US005525749A

United States Patent [19]

Aoki

[11] Patent Number: 5,525,749

[45] Date of Patent: Jun. 11, 1996

[54] MUSIC COMPOSITION AND MUSIC ARRANGEMENT GENERATION APPARATUS

[75] Inventor: Eiichiro Aoki, Hamamatsu, Japan

[73] Assignee: Yamaha Corporation, Japan

[21] Appl. No.: 13,615

[22] Filed: Feb. 4, 1993

[30] Foreign Application Priority Data

Feb. 7, 1992 [JP] Japan ..... 4-56743

[51] Int. Cl.[6] ..... A63H 5/00; G04B 13/00; G10H 7/00

[52] U.S. Cl. ..... 84/609; 84/634; 84/657

[58] Field of Search ..... 84/609, 610, 613, 84/634, 635, 637, 649, 657, DIG. 18

[56] References Cited

U.S. PATENT DOCUMENTS

| | | | |
|---|---|---|---|
| 4,416,182 | 11/1983 | Wise et al. . | |
| 4,499,808 | 2/1985 | Aoki . | |
| 4,508,002 | 4/1985 | Hall et al. . | |
| 4,982,643 | 1/1991 | Minamitaka | 84/613 |
| 5,003,860 | 4/1991 | Minamitaka | 84/609 |
| 5,088,380 | 2/1992 | Minamitaka . | |
| 5,179,241 | 1/1993 | Okada et al. | 84/613 |
| 5,418,322 | 5/1995 | Minamitaka | 84/609 |

FOREIGN PATENT DOCUMENTS 2-306283 12/1990 Japan .

*Primary Examiner*—William M. Shoop, Jr.
*Assistant Examiner*—Jeffrey W. Donels
*Attorney, Agent, or Firm*—Graham & James

[57] ABSTRACT

A musical composition/arrangement assisting apparatus for assisting a composition/arrangement of a multi-part music receives performance information such as melody information, chord information, or the like, and detects candidate tones harmonizing with the performance information. The candidate tones are notes on an available scale determined by a tonality and a chord. Avoid notes are excluded in terms of a chord tone architecture from the candidate tones. Furthermore, tones parallel to melody tones or tones in a minor ninth relation to melody tones are excluded from the candidate tones. The candidate tones are informed a user of and presented to him or her. The user selects tones from the candidate tones to generate musical tone data of another part. The user can compose/arrangement other parts of a music from the candidate tones presented in consideration of musical harmony. Therefore, all the composed/arranged parts are musically harmonized with each other.

15 Claims, 13 Drawing Sheets

| SCALE NAME | C | D | E | F | G | A | B |
|---|---|---|---|---|---|---|---|
| ionia | 1 0 1 0 1 1 0 1 0 1 0 1 | | | | | | |
| lydian | 1 0 1 0 1 0 1 1 0 1 0 1 | | | | | | |
| dorian | 1 0 1 1 0 1 0 1 0 1 1 0 | | | | | | |
| ⋮ | ⋮ | | | | | | |

MODE = MAJOR

| CHORD TYPE | SCALE NAME |
|---|---|
| M | lydian, ionia, mixolydian |
| m | dorian, phrygian |
| m7th | locrian |
| ⋮ | ⋮ |

| SCALE NAME | C | | D | | E | F | | G | | A | | B |
|---|---|---|---|---|---|---|---|---|---|---|---|---|
| ionia | 1 | 0 | 1 | 0 | 1 | 1 | 0 | 1 | 0 | 1 | 0 | 1 |
| lydian | 1 | 0 | 1 | 0 | 1 | 0 | 1 | 1 | 0 | 1 | 0 | 1 |
| dorian | 1 | 0 | 1 | 1 | 0 | 1 | 0 | 1 | 0 | 1 | 1 | 0 |
| ⋮ | | | | | | ⋮ | | | | | | |

FIG. 16A

TONALITY INPUT DISPLAY (STEP S41)

The 1st tonality
=
.....

FIG. 16B

MODURATION CONFIRMATION DISPLAY (STEP S49)

1 MAJ 3 BEAT
Pri. tonality = GM
Cur. tonality = CM
OK ?

FIG. 16C

EDIT PART DISPLAY (STEP S82)

Chord 1

FIG. 16D

CURRENT EDIT POSITION DISPLAY (STEP S86)

Chord 1
1 MAJ 1 BEAT 1

FIG. 16E

USER INPUT DISPLAY (STEP S121)

Chord 1
1 MAJ, 1 BEAT 1

E 1

MUSIC COMPOSITION AND MUSIC ARRANGEMENT GENERATION APPARATUS

BACKGROUND OF THE INVENTION

1. Field of the Invention

The present invention relates to a musical composition/arrangement assisting apparatus for assisting a musical composition or arrangement of a composer or an arranger by informing him or her of candidate tones harmonizing with performance information such as a melody, a tonality, chords, and the like.

2. Description of the Related Art

In doing composition or arrangement (to be referred to as "composition/arrangement" hereinafter) of a multi-part music having a predetermined key (or tonality), a musician selects tones in consideration of the tonality, melody, chords, and the like, so that all the parts musically harmonize with each other.

Some electronic musical instruments automatically generate an accompaniment part, and perform an automatic accompaniment. In an instrument of this type, when a player depresses a chord on a keyboard, accompaniment tones are automatically produced. In this case, an accompaniment part is generated regardless of a melody, and accompaniment tones are produced. For this reason, accompaniment tones musically harmonizing with the melody cannot always be obtained.

When a beginner having little knowledge about music composes/arranges a multi-part music, he or she does not often know which tones are to be selected. More specifically, it is difficult especially for a person having little musical knowledge to compose/arrange a music with musically harmonizing intervals observed in all the parts.

As described above, with the automatic accompaniment function of a conventional electronic musical instrument, musically harmonizing accompaniment tones cannot always be obtained.

SUMMARY OF THE INVENTION

It is an object of the present invention to provide a musical composition/arrangement assisting apparatus, which assists to compose/arrange a multi-part music in consideration of musical harmony of tones in a given part with respect to other parts, and allows easy composition/arrangement of a music even when a person having little musical knowledge composes/arranges a music.

A musical composition/arrangement assisting apparatus according to the present invention comprises performance information input means for inputting performance information corresponding to at least one part of a music to be performed which comprises plural parts, candidate note determining means for determining a candidate note for another part of said music, said candidate note being determined by said performance information, and informing means for informing an operator of said candidate note.

As the performance information, for example, melody information, tonality information, chord information, or the like is used. Alternatively, a tonality or chords may be obtained on the basis of a melody.

As rules for determining candidate notes, general musical rules can be used. For example, the following rules are used.

① A diatonic scale based on a tonality at that time is used. An available scale is determined by the start pitch of a reference tone. For example, when the current tonality is C major, and the current chord is a C major chord, since the available scale is an Ionian scale, tones on the Ionian scale are determined as candidate tones. When the current chord is a D minor chord, since the available scale is a Dorian scale, tones on the Dorian scale is determined as candidate tones. In this manner, the candidate tones can be determined using the available scale according to the tonality and chord at that time.

② Avoid notes which should be excluded in terms of a chord sound architecture are excluded from candidate tones. For example, since the fourth tone on the Ionian scale is the avoid note, it is excluded from the candidate tones.

③ Tones parallel to melody tones are to be avoided. For example, tones which move parallel to melody tones in a perfect fifth or octave interval are inhibited.

④ Tones in a minor ninth relation to melody tones are excluded. For example, when the melody tone is E, E♭ is prevented from being selected as a candidate tone.

By using these rules ① to ④, candidate tones with respect to melody tones as one part are informed and presented to a user.

After the candidate tones are informed a user of, he or she may store the inputted tone data, and these data may be held as musical tone data in another part musically harmonizing a melody part. For example, musical tone data in all the parts may be generated as data complying with the MIDI standards.

Since candidate tones harmonizing with performance information inputted from the performance information input means are determined and informed even a person having little musical knowledge of, he or she can compose/arrange another musically harmonizing part by only selecting tones from the informed candidate tones. Contrary to this, a user may select tones other than the candidate tones so as to intentionally obtain an unstable music.

BRIEF DESCRIPTION OF THE DRAWINGS

FIGS. 16A to 16E are views showing display examples on a display device.

DETAILED DESCRIPTION OF THE PREFERRED EMBODIMENT

The preferred embodiment of the present invention will be described hereinafter with reference to the accompanying drawings.

Figure 1:
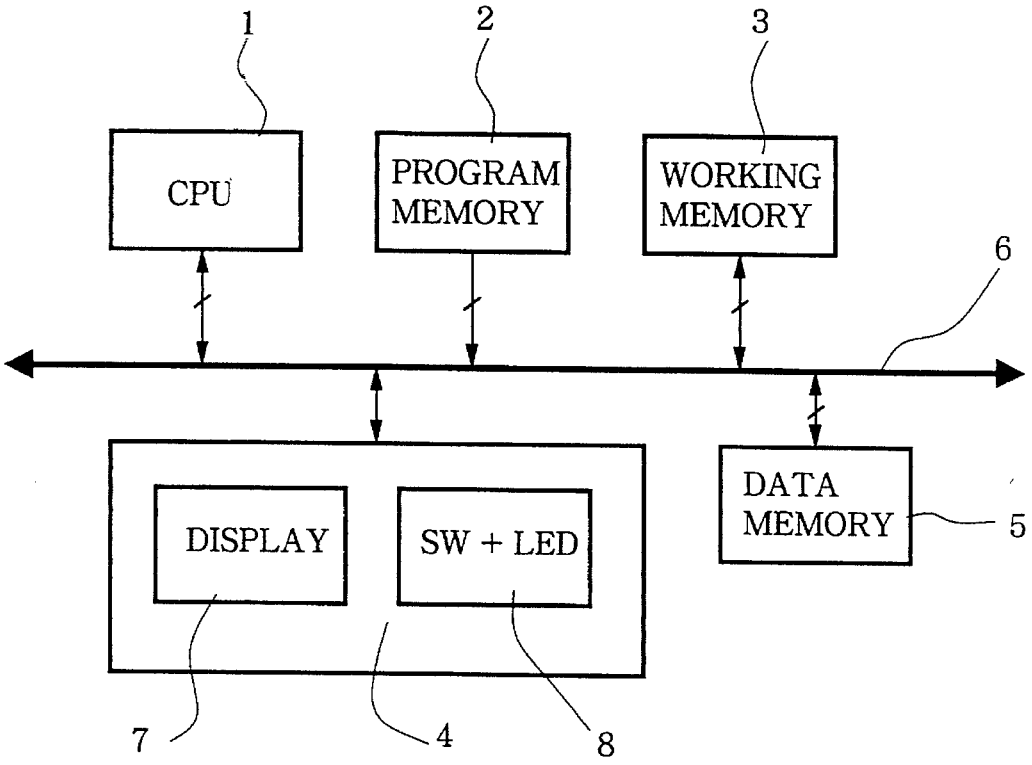
FIG. 1 is a block diagram showing an arrangement of a musical composition/arrangement assisting apparatus according to an embodiment of the present invention.

FIG. 1 is a block diagram showing an arrangement of a musical composition/arrangement assisting apparatus according to an embodiment of the present invention. The musical composition/arrangement assisting apparatus comprises a central processing unit (CPU) 1 for controlling the operation of the overall apparatus, a program memory 2 for storing a program executed by the CPU 1, a working memory 3 assigned with various registers, flags, and the like, a panel unit 4, and a data memory 5 for storing melody data, and the like. The panel unit 4 comprises a display 7 for displaying various kinds of information, and a switch & LED unit 8 comprising, e.g., various switches. Reference numeral 6 denotes a bus line for connecting these units.

Figure 2:
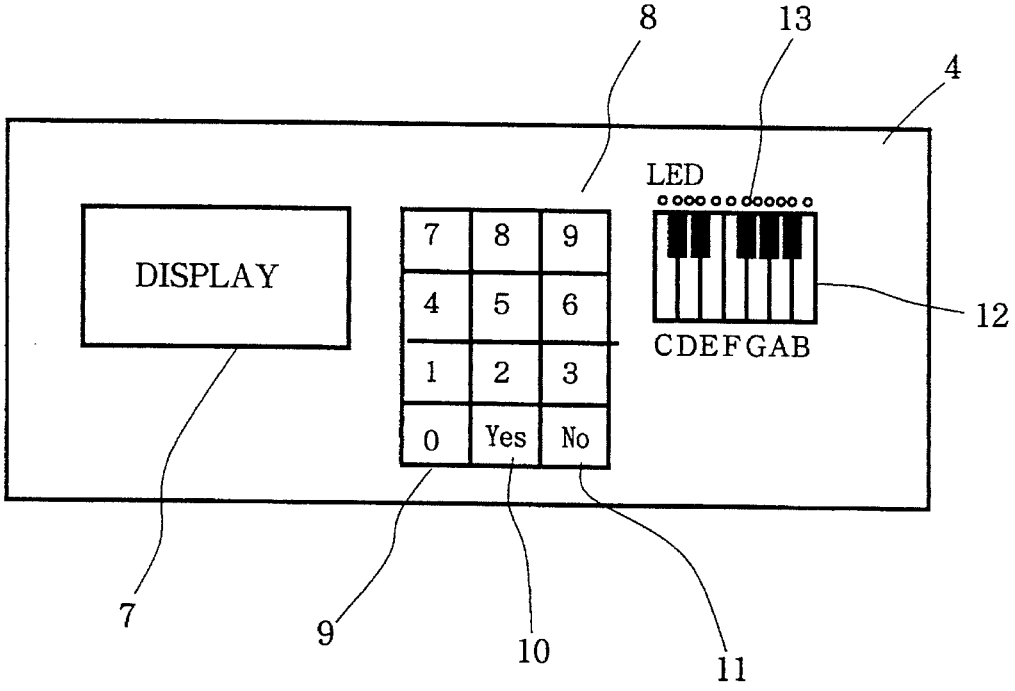
FIG. 2 is a plan view showing the outer appearance of a panel unit.

FIG. 2 shows the detailed outer appearance of the panel unit 4. The switch & LED unit 8 comprises a ten-key pad 9, a keyboard 12, and LEDs 13. The ten-key pad 9 includes numeric keys "0" to "9", and YES and NO keys 10 and 11. The keyboard 12 consists of 12 keys (seven white keys and five black keys) for one octave, and pitch names "CDEFGAB" are printed on a portion below the white keys. Twelve LEDs 13 are arranged on a portion above the 12 keys of the keyboard 12, and respectively correspond to the keys of the respective pitch names.

The operations of the musical composition/arrangement assisting apparatus of this embodiment will be briefly explained below.

① A user desirably creates a fundamental melody and chords. These data may be input using the keyboard 12 or the ten-key pad 9 shown in FIG. 2, or data created in advance using another apparatus may be transferred to the assisting apparatus according to, e.g., the MIDI standards. In the musical composition/arrangement assisting apparatus of this embodiment, assume that the melody and chord created by the user are pre-stored in the data memory 5 as melody data and chord data.

② When the remaining parts of a music are to be composed/arranged, the user depresses a musical composition/arrangement start key (not shown). Thus, the user can start composition/arrangement of the remaining parts of the music under the assistance of this apparatus.

③ The display 7 of this apparatus displays a message for urging a user to input the first tonality of the music. The user inputs the first tonality (e.g., C major, D minor, or the like) of the music.

④ The display 7 of this apparatus displays a message for confirming a modulation. If there is a possibility of modulation in the middle of the music, a modulation candidate is presented to urge a user to select whether or not a modulation is made. Even in the same chord progression, a modulation should or should not be made depending on the will of a user who creates the music. Thus, a message is displayed to urge a user to confirm whether or not a modulation is made.

⑤ Candidate tones are detected in accordance with the tonality, melody data, and chord data in respective parts (four parts in this embodiment), and the LEDs 13 corresponding to the pitch names of the candidate tones flash. A user depresses the keyboard 12 with reference to the flashing LEDs, thereby inputting tones constituting each part. Musical tone data of the input tones are stored in the data memory 5 as edit data. This operation is performed for four parts.

With the above-mentioned steps ① to ⑤, final musical tone data of all the parts are generated.

Figure 3A:
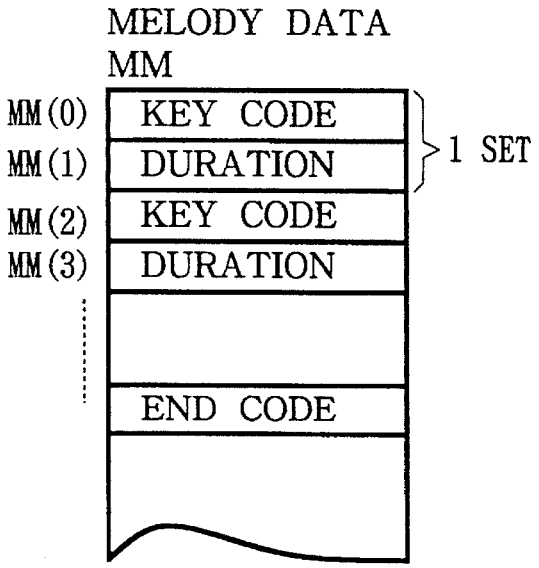
FIGS. 3A to 3C are views showing formats of various data stored in a data memory.
Figure 3B:
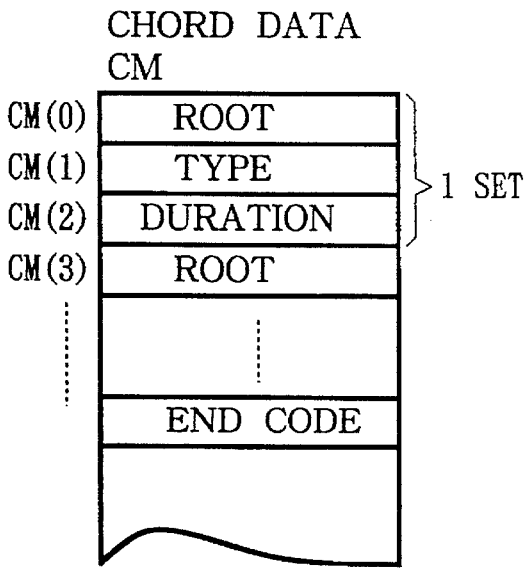
Figure 3C:
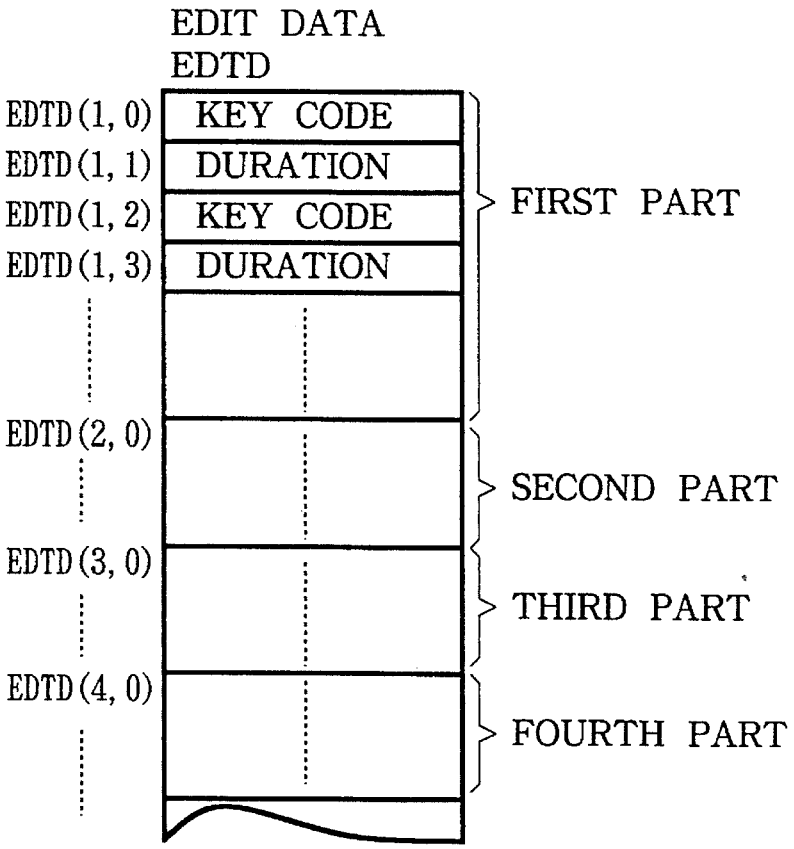

The formats of the melody data, chord data, and edit data stored in the data memory 5 will be explained below. FIGS. 3A to 3C show the formats of these data stored in the data memory 5 (FIG. 1).

FIG. 3A shows the format of melody data MM. The melody data MM is constituted by a plurality of sets of key code data and subsequent duration data. One set of key code data (including a rest) and subsequent duration data specify one tone constituting the melody. More specifically, the key code data designates the tone pitch of the corresponding tone, and the duration data specifies a time duration for which the corresponding tone is produced. An end code is stored at the end of the melody data. The melody data is array type data, and data constituting the melody data are accessed in the order of MM(O), MM(1), . . . , as shown in FIG. 3A.

The duration data is defined in units of time durations obtained by equally dividing a time duration for one bar with 16. In the following description, the same unit applies to duration data of chord data, and the like.

FIG. 3B shows the format of chord data CM. The chord data CM is constituted by a plurality of sets of root data, type data, and duration data (arrayed in this order). One set of data specify one chord. More specifically, the root data specifies the root of the corresponding chord, the type data specifies the type of the chord (e.g., major, minor, or the like), and the duration data specifies the duration of the chord. An end code is stored at the end of the chord data. The chord data CM is array type data, and is accessed in the order of CM(0), CM(1), . . . as in the melody data MM.

FIG. 3C shows the format of edit data EDTD. The edit data EDTD stores four parts of musical tone data input by a user. The edit data EDTD is two-dimensional array type data. Musical tone data of the first part are stored in areas having the first suffix="1", i.e., in areas EDTD(1,0), EDTD(1,2), EDTD(1,3), . . . . Similarly, musical tone data of the second part are stored in areas EDTD(2,n) having the first suffix="2", musical tone data of the third part are stored in areas EDTD(3,n) having the first suffix="3", and musical tone data of the fourth part are stored in areas EDTD(4,n) having the first suffix="4".

Musical tone data of each part consist of a plurality of sets of key code data and duration data (arrayed in this order). One set of data specify one tone constituting the corresponding part. More specifically, the key code data specifies the tone pitch of the tone, and the duration data specifies the duration of the tone. An end code is stored at the end of the data of each part.

A table and candidate tone detection rules used for detecting candidate tones in the musical composition/arrangement assisting apparatus of this embodiment will be described below. In this embodiment, the two rules ① and ④ described in the paragraphs of "SUMMARY OF THE INVENTION" are used as candidate tone detection rules. More specifically, an available scale (to be referred to as an "AV scale" hereinafter) is determined according to whether the current chord is a diatonic chord of the current tonality, a non-diatonic chord within the current tonality, or a non-diatonic chord outside the current tonality, and tones in a minor ninth relation to melody tones or tones in other parts are excluded.

Figures 4, 5:
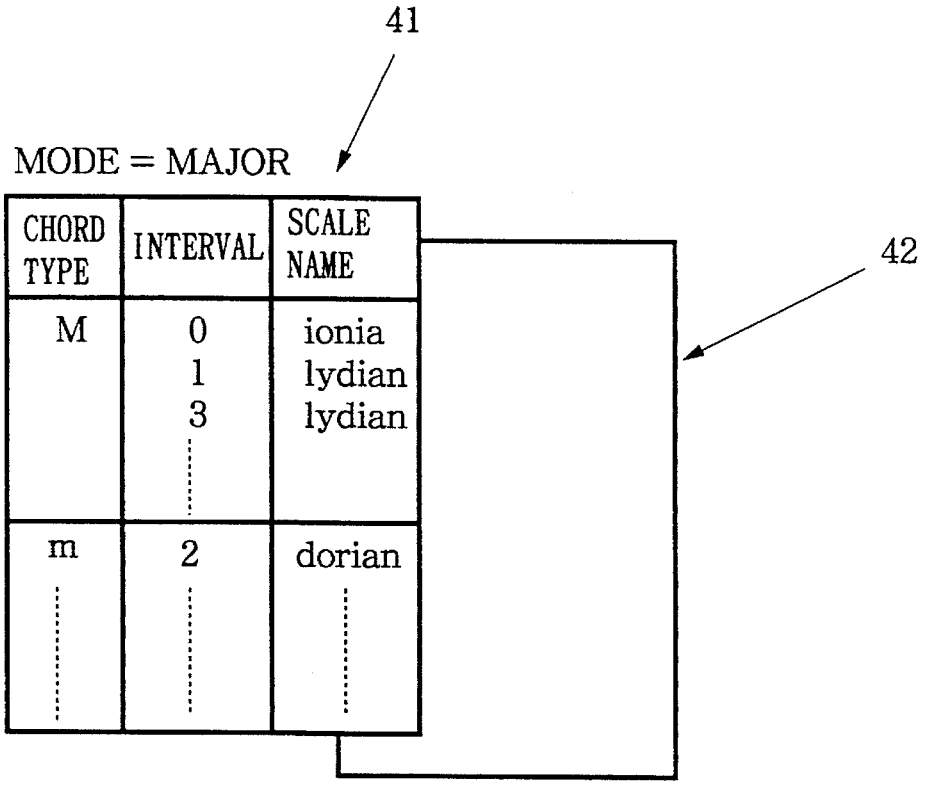
FIG. 4 is a table showing available (AV) scales used when the current chord is a diatonic code of the current tonality or a non-diatonic chord in the current tonality.
FIG. 5 is a table showing AV scales used when the current chord is a non-diatonic chord outside the current tonality.

FIG. 4 shows an AV scale table used when the current chord is a diatonic chord of the current tonality or a non-diatonic chord within the current tonality. Reference numeral 41 denotes an AV scale table used when the current tonality is major; and 42, an AV scale table used when the current tonality is minor. The CHORD TYPE in each table indicates the current chord type, i.e., major (represented by "M" in FIG. 4) or minor (represented by "m" in FIG. 4). The INTERVAL in each table indicates an interval between the tone pitch of a key code of the root of the current chord and the tone pitch of a key code of the tonic of the current tonality, and is calculated by:

$$\text{Tone pitch difference}=(\text{root code}+12-\text{tonic code}) \bmod 12$$

The root code is the key code of the root of the current chord, and the tonic chord is the key code of the tonic of the current tonality.

The SCALE NAME indicates AV scales determined according to the corresponding chord types and intervals. For example, when the current tonality is major, the current chord is major, and the interval is "1", a lydian scale is used as the AV scale; and when the current tonality is major, the current chord is minor, and the interval is "2", a dorian scale is used as the AV scale.

FIG. 5 shows an AV scale table used when the current chord is a non-diatonic chord outside the current tonality. The meanings of the chord type and scale name are the same as those in FIG. 4. When there are a plurality of scale names in correspondence with one chord type, candidate tones are determined by calculating the sum of sets of tones of these scales.

Figures 6, 7:
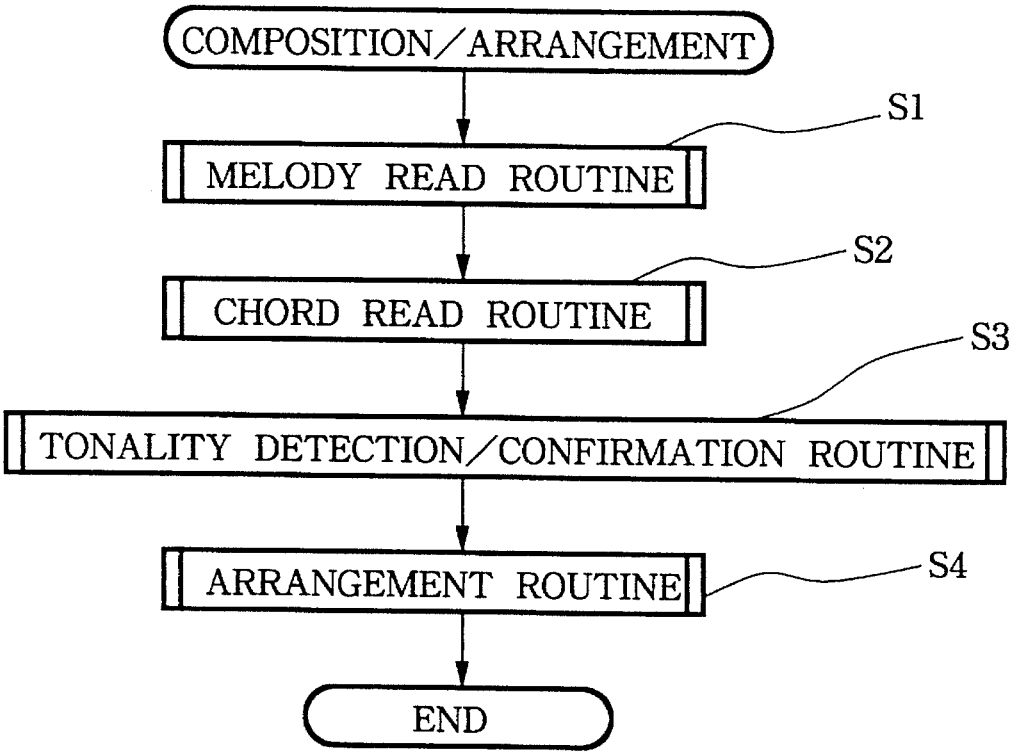
FIG. 6 is a scale table storing candidate tones according to scales.
FIG. 7 is a flow chart of a composition/arrangement main routine.

FIG. 6 shows a scale table storing candidate tones according to scales. Candidate tones corresponding to each scale name are represented by 12-bit data. "1" indicates that a tone of the corresponding pitch name is a candidate tone, and "0" indicates that a tone of the corresponding pitch name is not a candidate tone. For example, as can be seen from bit data "101011010101" corresponding to the scale name "ionia", "C", "D", "E", "F", "G", "A", and "B" are candidate tones, and "C#(D♭)", "D#(E♭)", "F#(G♭)", "G#(A♭)", and "A#(B♭)" are not candidate tones.

The correspondence between the scale names and pitch names of candidate tones shown in this table is effective when the root of a chord is "C". Therefore, bit data representing actual candidate tones is obtained by rotating the bit data obtained from this scale table in the right direction (cyclically shifting bits to the right) according to the root of the current chord.

For example, when the scale name "ionia" is determined, and bit data "101011010101" is read out, if the key code of the root of the current chord is "D", bit data "011010110101" obtained by rotating the bit data "101011010101" a plurality of number of times corresponding to the key code value of "D" in the right direction is used as data representing the pitch names of actual candidate tones. Since the key code "C" is a multiple of "12", the bit data need only be rotated by a plurality of number of times corresponding to a value indicated by the key code of the root of the current chord.

Registers and flags used in the musical composition/arrangement assisting apparatus of this embodiment will be explained below.

(a) Melody key code register MP(n): This register is an array type register for storing only key code data extracted from the melody data MM.

(b) Melody duration register ML(n): This register is an array type register for storing only duration data extracted from the melody data MM.

(c) Melody data note count register MN: This register is set with the number of notes stored in the melody data MM.

(d) Chord root register CRT(n): This register is an array type register for storing only root data extracted from the chord data CM.

(e) Chord type register CTP(n): This register is an array type register for storing only type data extracted from the chord data CM.

(f) Chord duration register CL(n): This register is an array type register for storing only duration data extracted from the chord data CM.

(g) Chord data count register CN: This register is set with the number of chords stored in the chord data CM.

(h) Tonality tonic register TN(n): The tonality of a music sequentially changes from the beginning of the music every time a modulation is made. This register is an array type register for storing key codes indicating the tonics of the corresponding tonalities.

(i) Tonality mode register MD(n): This register is an array type register for storing data indicating the modes (major or minor) of the corresponding tonality from the beginning of a music.

(j) Tonality length register TL(n): This register is an array type register for storing data indicating the lengths of the corresponding tonalities from the beginning of a music.

(k) Tonality count register TNN: This register stores the number of tonalities used in a music. The number of tonalities is also the number of data in the tonality tonic register TN(n) and the mode register MD(n).

(l) Tonic register TTN: This register stores the tonic of the current tonality upon detection of a modulation.

(m) Mode register TMD: This register stores data indicating the mode (major or minor) of the current tonality upon detection of a modulation.

(n) Modulation detection flag FLG: This flag is set to be "1" upon detection of a modulation; otherwise, it is set to be "0".

(o) Candidate tone register SCHL: This register is a 12-bit register, and 12 bits respectively correspond to "C", "C#(D♭)", "D", "D#(E♭)", "E", "F", "F#(G♭)", "G", "G#(A♭)", "A", "A#(B♭)", and "B" in turn. "1" is set in a bit corresponding to the pitch name of a candidate tone, and "0" is set in a bit corresponding to the pitch name of a non-candidate tone.

(p) Part register PRT: This register stores a value ranging between "1" and "4" indicating the part which is being currently processed.

The symbols indicating the registers and the like indicate not only the registers themselves, but also data stored in the corresponding registers. For example, PRT indicates the part register, and also indicates data indicating the part stored in the part register. The suffix n of the array type register is n=0, 1, 2, . . . .

The operation of the musical composition/arrangement assisting apparatus shown in FIG. 1 will be described in detail below with reference to the flow charts of FIGS. 7 to 15.

Figure 8:
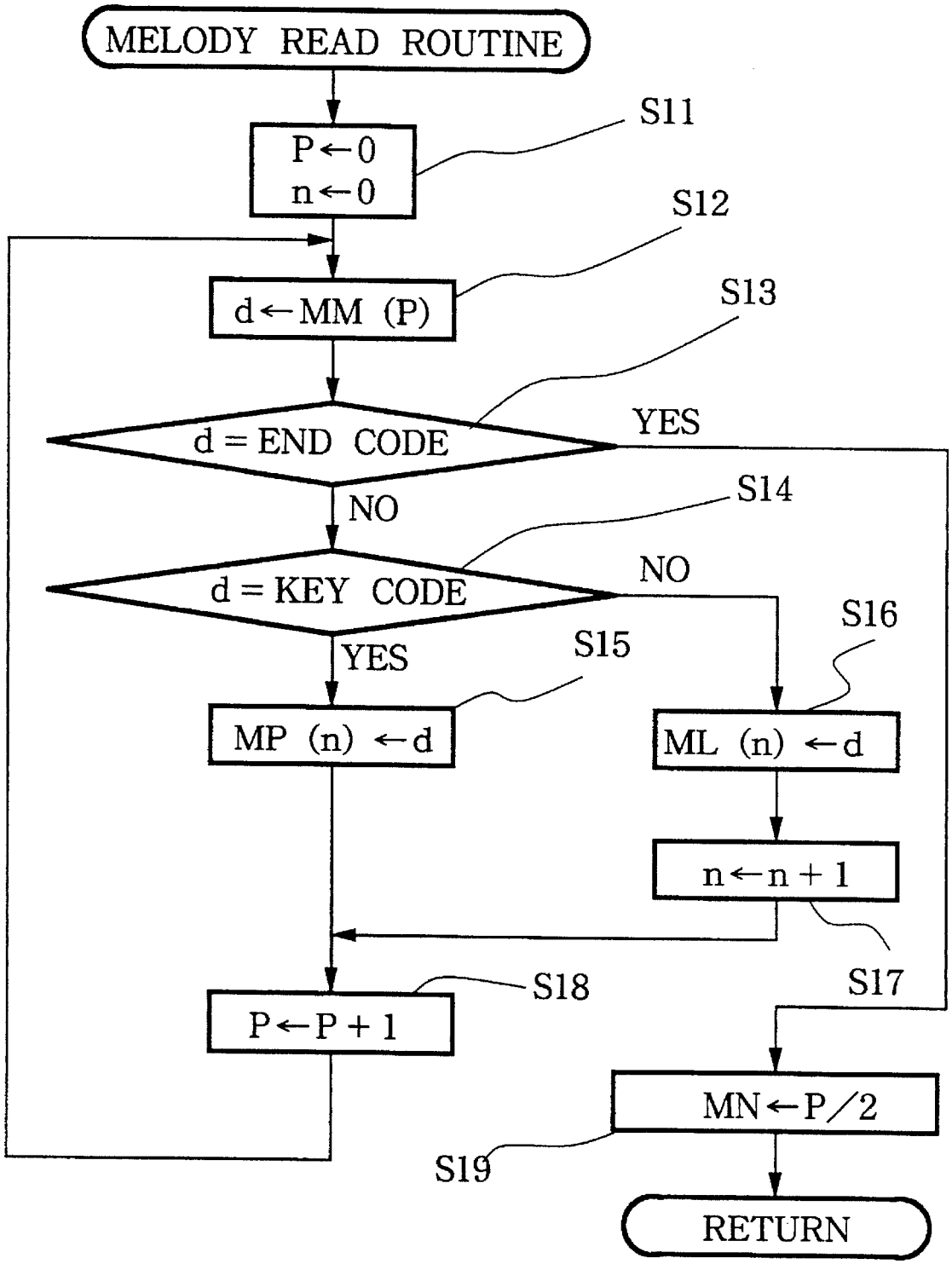
FIG. 8 is a flow chart of a melody read routine.
Figure 9:
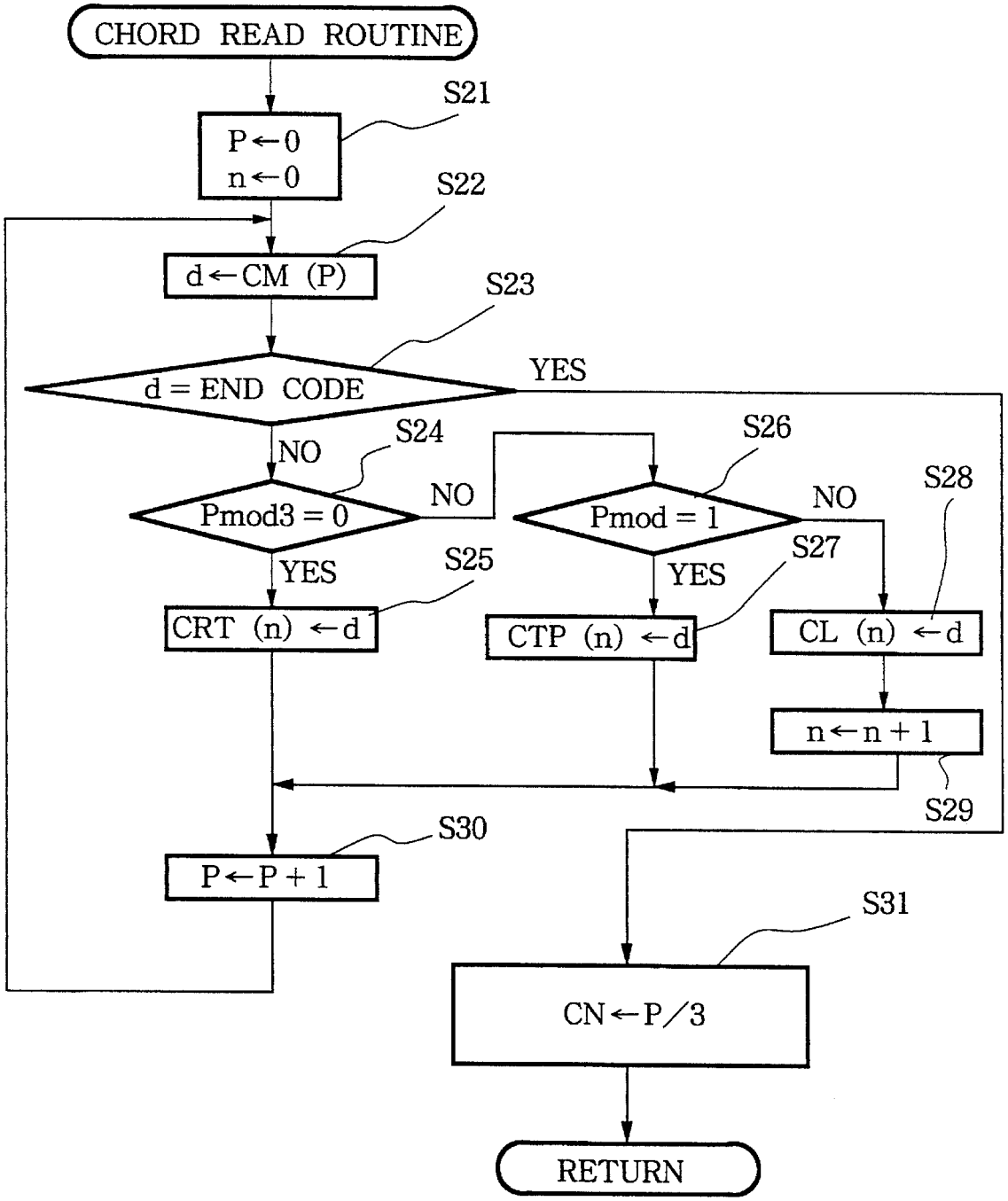
FIG. 9 is a flow chart of a chord read routine.
Figure 10:
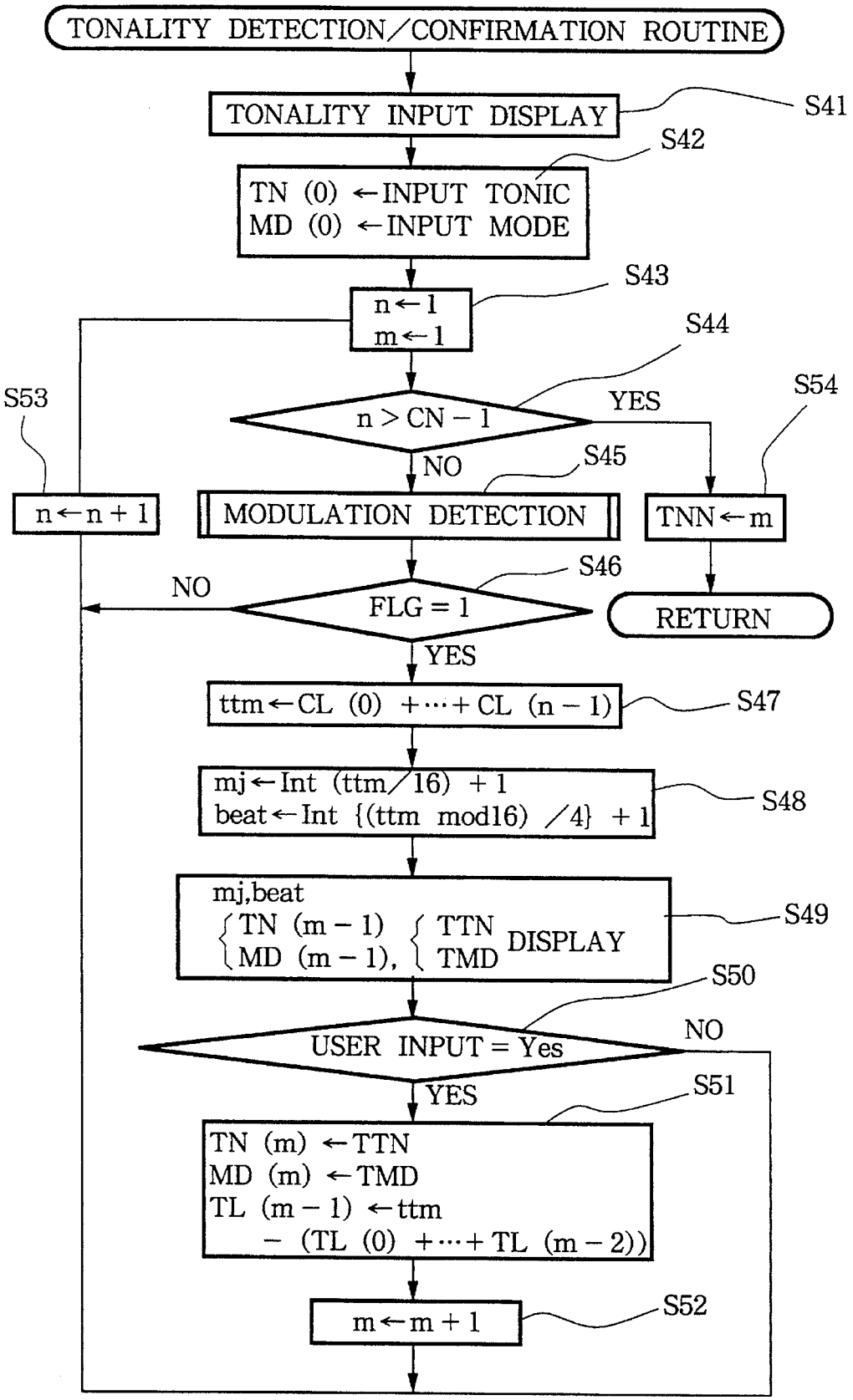
FIG. 10 is a flow chart of a tonality detection/checking routine.

FIG. 7 shows a musical composition/arrangement main routine executed upon depression of the musical composition/arrangement start key (not shown) by a user. In step S1, the CPU 1 calls a melody read routine (FIG. 8). In step S2, the CPU 1 calls a chord read routine (FIG. 9). In step S3, the CPU 1 calls a tonality detection/confirmation routine (FIG. 10). In step S4, the CPU 1 calls an arrangement routine (FIG.

12). Thereafter, the flow returns to step S1. The above-mentioned routines are repeated.

In the melody read routine shown in FIG. 8, processing for extracting key code data and duration data from the melody data MM, and setting these data in the melody key code register MP(n) and the melody duration register ML(n), and the like are executed. In step S11, working registers p and n are cleared to zero. In step S12, one element MM(p) is read out from the melody data MM, and is set in a working register d.

In step S13, it is checked if the data in the working register d is an end code. If NO in step S13, it is then checked in step S14 if the data in the working register d is a key code. If YES in step S14, the key code set in the working register d is set in the melody key code register MP(n) in step S15, and the flow advances to step S18. However, if NO in step S14, since the data is duration data, the duration data set in the working register d is set in the melody duration register ML(n) in step S16. In step S17, the content of the working register n is incremented by 1, and the flow advances to step S18.

In step S18, the content of the working register p is incremented by 1, and the flow returns to step S12. The same processing is repeated to set readout data in the melody key code registers MP(n) and the melody duration registers ML(n) until the end code is read out from the melody data MM. If it is determined in step S13 that the data set in the working register d is an end code, the flow advances to step S19. In step S19, a quotient obtained by dividing the content of the working register p by "2" is set in the melody data note count register MN, and thereafter, the flow returns to the main routine.

In the chord read routine shown in FIG. 9, processing for extracting root data, type data, and duration data from the chord data CM, and setting these data in the chord root register CRT(n), the chord type register CTP(n), and the chord duration register CL(n), and the like are executed. In step S21, working registers p and n are cleared to zero. In step S22, one element CM(p) is read out from the chord data CM, and is set in a working register d.

In step S23, it is checked if the data in the working register d is an end code. If NO in step S23, "p mod 3" is calculated, and it is checked if the calculation result is "0", in step S24. "p mod 3" represents a remainder obtained by dividing the value of the working register d by "3". When "p mod 3"="0", since this means that the data read out and set in the working register d is root data, the root data in the working register d is set in the chord root register CRT(n) in step S25, and the flow advances to step S30.

If it is determined in step S24 that "p mod 3"≠"0", it is checked in step S26 if "p mod 3"="1". If YES in step S26, since this means that the data read out and set in the working register d is type data, the type data in the working register d is set in the chord type register CTP(n) in step S27, and the flow advances to step S30.

If it is determined in step S26 that "p mod 3"≠"1", since this means that the data read out and set in the working register d is duration data, the duration data in the working register d is set in the chord duration register CL(n) in step S28. In step S29, the content of the working register n is incremented by 1, and the flow then advances to step S30.

In step S30, the content of the working register p is incremented by 1, and the flow then returns to step S22. The same processing is repeated to set readout data in the chord root registers CRT(n), the chord type registers CTP(n), and the chord duration register CL(n) until an end code is read out from the chord data CM. If it is determined in step S23 that the data set in the working register d is an end code, the flow advances to step S31. In step S31, a quotient obtained by dividing the content of the working register p by "3" is set in the chord data count register CN, and the flow then returns to the main routine.

The tonality detection/confirmation routine in step S3 in FIG. 7 will be described below with reference to the flow chart of FIG. 10. In the tonality detection/confirmation routine, in step S41, a tonality input display is performed for urging a user to input the first tonality of a music. FIG. 16A shows a display example on the display 7 in the tonality input display. The user inputs the first tonality of a music using, e.g., the keyboard 12 according to the display.

When the user inputs the tonality, the tonic of the input tonality is set in the start element TN(0) of the tonic register, and the mode of the input tonality is set in the start element MD(0) of the mode register, in step S42. In step S43, "1" is set in working registers n and m, and it is then checked in step S44 if the content of the working register n is larger than a difference obtained by subtracting "1" from the chord data count CN. If NO in step S44, the CPU 1 calls a modulation detection routine (FIG. 11), and it is then checked in step S46 if the modulation detection flag FLG is "1".

In the modulation detection routine, it is detected if a modulation is made upon transition in the chord data CM from an (n−1)-th chord to an n-th chord using the content of the working register n as a suffix. More specifically, the presence/absence of a modulation upon transition from a chord specified by chord root data CRT(n−1), chord type data CTP(n−1), and chord duration data CL(n−1) to a chord specified by chord root data CRT(n), chord type data CTP(n), and chord duration data CL(n) is detected.

If it is determined in step S46 that the modulation detection flag FLG is not "1", since this means that no modulation is detected in the modulation detection routine, the working register n is incremented by 1 in step S53, and the flow returns to step S44. However, if it is determined in step S46 that the modulation detection flag FLG is "1", since this means that a modulation is detected in the modulation detection routine, the flow advances to step S47.

In step S47, a sum of chord duration data CL(0), CL(1), . . . , CL(n−1) is calculated, and is set in a work register ttm. In this processing, the durations from the beginning of a music up to a chord immediately before the modulation is detected are added, and a modulation detection position is set.

In step S48, a value obtained by adding "1" to an integral part of a quotient obtained by dividing the modulation detection position ttm by "16", i.e., the position of the modulation-detected bar from the beginning of a music is set in a working register mj. A value obtained by adding "1" to an integral part of a quotient obtained by further dividing by "4" the remainder obtained by dividing the modulation detection position ttm by "16", i.e., a beat position indicating a specific beat in the bar corresponding to the modulation detection position, is set in a working register beat. In this case, a four-four time is assumed.

In step S49, the bar position mj and the beat position beat where the modulation is detected are displayed on the display 7. In addition, the tonic TN(m−1) and mode MD(m−1) of the tonality immediately before the modulation is detected are displayed. The tonic TTN and the mode TMD are set in the modulation detection routine in step S45.

FIG. 16B shows a display example on the display 7 in step S49. In this example, the modulation from G major to C major is detected at the third beat in the first bar. In addition, a character string "OK?" for urging the user to confirm the displayed modulation is displayed. When the user confirms the displayed modulation, he or she depresses the YES key 10; otherwise, he or she depresses the NO key 11.

When the YES key 10 is depressed, the tonic TNN and the mode TMD of the tonic at the position where the modulation is detected are respectively set in the tonic register TN(m) and the mode register MD(m) in step S51. A sum of tonality lengths TL(0), TL(1), . . . , TL(m−2) is calculated, and is subtracted from the current modulation detection position ttm to obtain a length from the current modulation detection position to the previous modulation detection position, i.e., the length of the previous tonality. The calculated previous tonality is set in the tonality length register TL(m−1). When m=1, since this means that the first modulation is detected from the beginning of a music, the modulation detection position ttm is set in the tonality length register TL(m−1)= TL(0).

In step S52, the content of the working register m is incremented by 1, and the flow advances to step S53. In step S53, the content of the working register n is incremented by 1, and the flow returns to step S44 to execute the next modulation detection processing. If it is determined in step S50 that the user depresses the NO key 11, the flow advances to step S53.

If it is determined in step S44 that the content of the working register n becomes larger than a difference obtained by subtracting "1" from the chord data count CN, since this means that all the chord data are confirmed, the content of the working register m is set in the tonality count register TNN, and the flow returns to the main routine.

Figure 11:
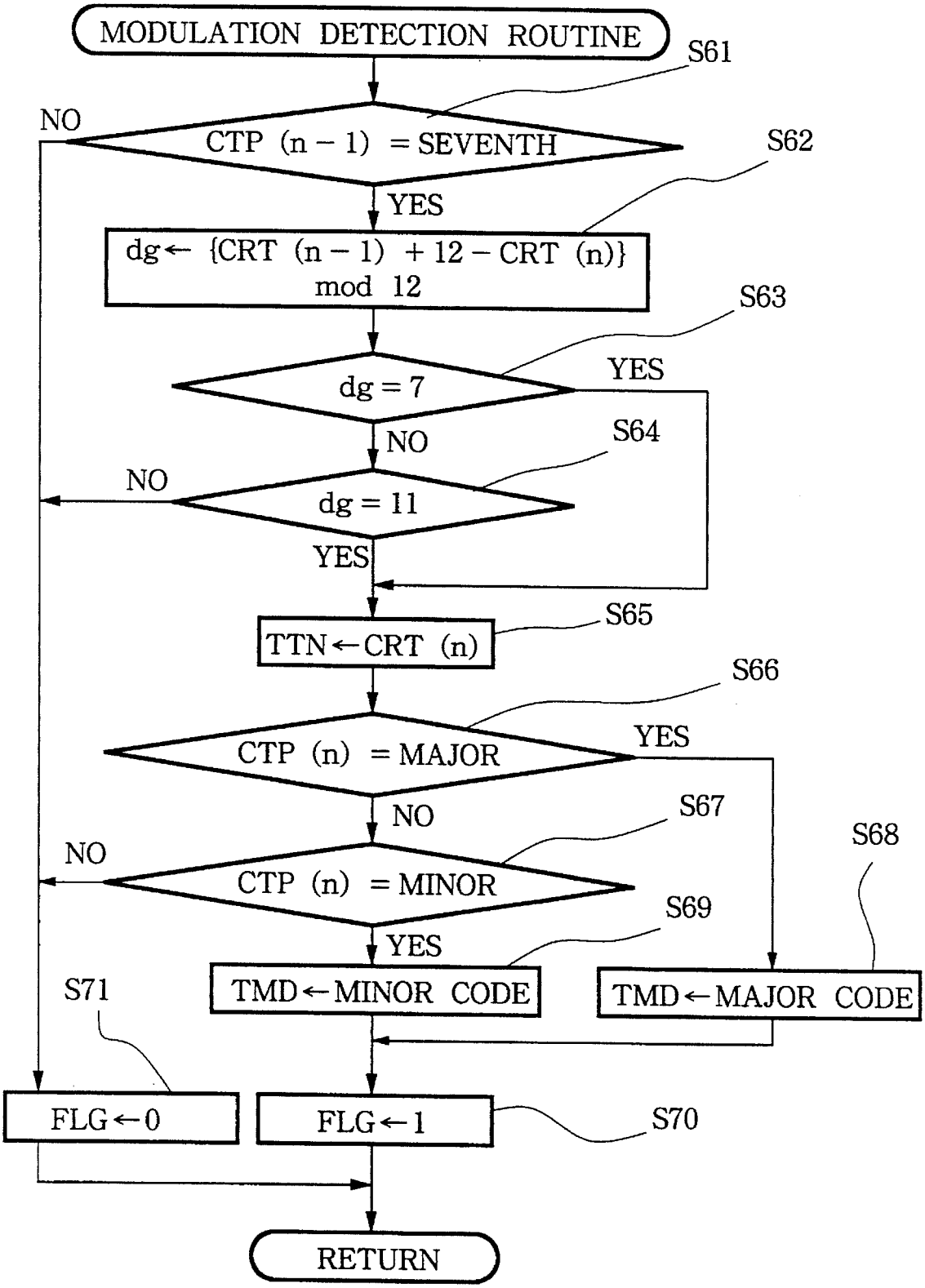
FIG. 11 is a flow chart of a modulation detection routine.

The modulation detection routine will be described below with reference to the flow chart shown in FIG. 11. In the modulation detection routine, in step S61, it is checked if the type CTP(n−1) of the immediately preceding chord (a chord accessed by the suffix n is used as reference data which is being currently processed) is a seventh. If NO in step S61, it is determined that no modulation is made, and the modulation detection flag FLG is reset to "0" in step S71. Then, the flow returns to the tonality detection/confirmation routine.

However, if YES in step S61, since there is a possibility of modulation, the flow advances to step S62. In step S62, a degree difference between the root CRT(n−1) of the immediately preceding chord and the root CRT(n) of the current chord is calculated, and is set in a working register dg. It is checked in step S63 if the degree difference dg="7". If YES in step S63, since it is determined that the root makes a dominant motion, the flow advances to step S65. However, if NO in step S63, it is checked in step S64 if the degree difference dg="11".

If NO in step S64, it is determined that no modulation is made, and the flow advances to step S71. However, if YES in step S64, the root CRT(n) of the current chord is set in the tonic register TTN as the tonic of the current tonality in step S65.

It is then checked in step S66 if the type CTP(n) of the current chord is major. If YES in step S66, a major code indicating that the mode of the current tonality is major is set in the mode register TMD in step S68, and the flow advances to step S70. If NO in step S66, it is checked in step S67 if the chord type CTP(n) is minor. If NO in step S67, it is determined that no modulation is made, and the flow advances to step S71.

However, if YES in step S67, a minor code indicating that the mode of the current tonality is minor is set in the mode register TMD in step S69, and the flow advances to step S70. In step S70, "1" indicating that the modulation is detected is set in the modulation detection flag FLG, and the flow returns to the tonality detection/confirmation routine.

Figure 12:
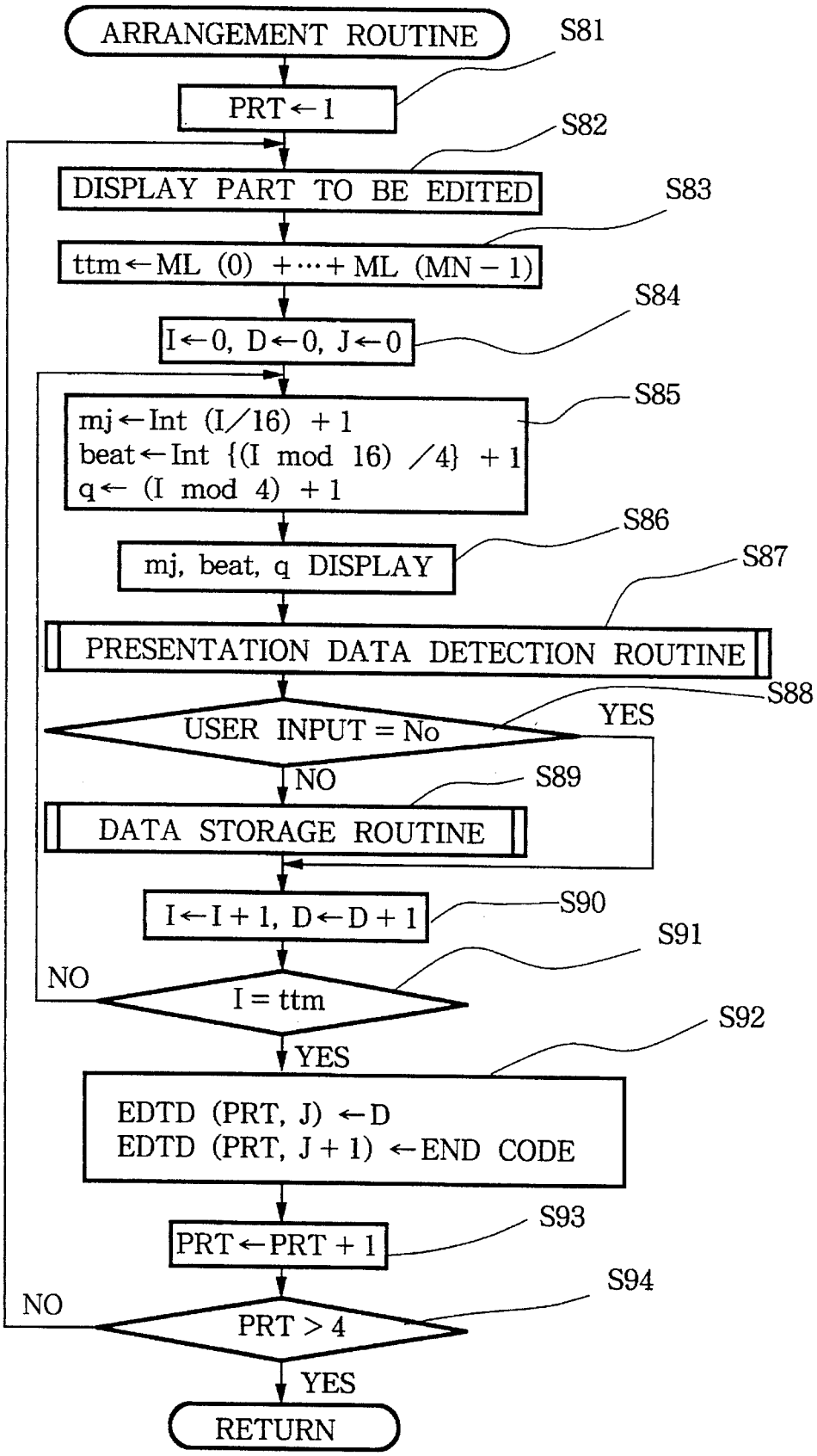
FIG. 12 is a flow chart of an arrangement routine.

The arrangement routine in step S4 in FIG. 7 will be described below with reference to the flow chart of FIG. 12. In the arrangement routine, in step S81, an initial value "1" is set in the part register PRT, and in step S82, a part to be edited is displayed.

FIG. 16C shows a display example of the part to be edited on the display 7. In this embodiment, four parts are composed/arranged. The first, second, and third parts (PRT=1, 2, and 3) are accompaniment chord parts, and the fourth part (PRT=4) is a bass part. The display example of FIG. 16C indicates that a part to be edited is the chord part as the first part.

After the part to be edited is displayed, a sum of all the duration data ML(0), ML(1), . . . , ML(MN−1) of the melody, i.e., the total duration of the melody is calculated, and is set in a working register ttm. In step S84, working registers I, D, and J are initialized to "0", and the flow advances to step S85.

Note that the working register I stores data indicating the current edit position. The current edit position I is a value counted from the beginning of a music in units of time durations obtained by equally dividing the time duration of one bar by 16. The working register D is a counter for detecting a duration of musical tone data inputted by the user. The content of the working register J is as a suffix of edit data EDTD.

In step S85, a value obtained by adding "1" to an integral part of a quotient obtained by dividing the current edit position I by "16", i.e., a value indicating the bar position of the current edit position, is set in a working register mi. Also, a value obtained by adding "1" to an integral part of a quotient obtained by further dividing by "4" the remainder obtained by dividing the current edit position I by "16", i.e., the beat position in the bar of the current edit position, is set in a working register beat. Furthermore, a value obtained by adding "1" to the remainder obtained by dividing the current edit position I by "4", i.e., data indicating which of four-divided positions in the beat the current edit position corresponds to (to be referred to as a "quantize" hereinafter), is set in a working register q.

In step S86, the bar position mj, the beat position beat, and the quantize q indicating the current edit position are displayed on the display 7. FIG. 16D shows a display example in step S86. This display example indicates that the current edit part is the first part, and the quantize of the first beat of the first bar corresponds to a position "1".

Figure 13:
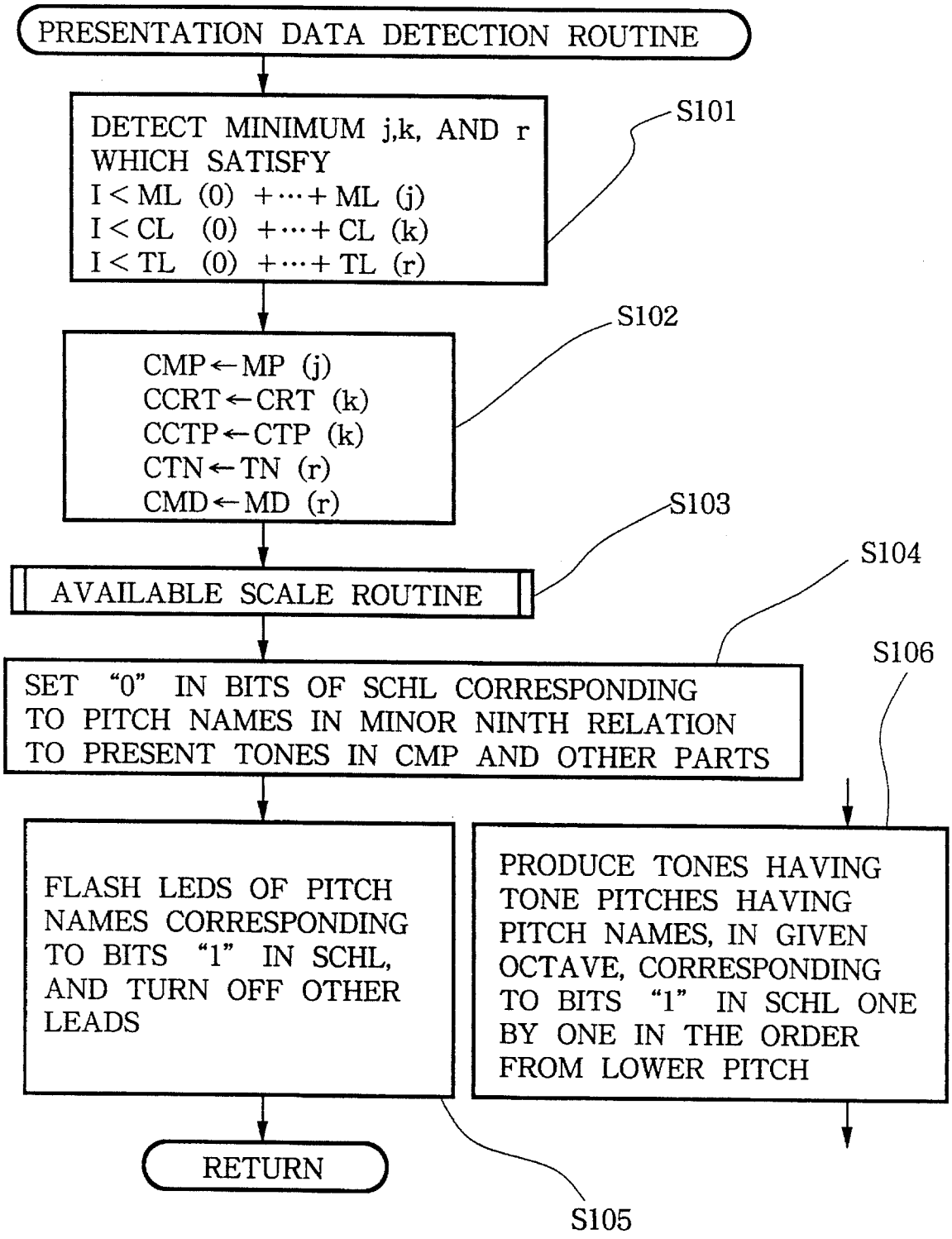
FIG. 13 is a flow chart of a presentation data detection routine.

In step S87, the CPU 1 calls a presentation data detection routine (FIG. 13). In the presentation data detection routine, processing for flashing the LEDs 13 corresponding to candidate tones is performed. In step S88, a user input is accepted, and it is checked if the user input is the NO key 11. If YES in step S88, since this means that no new musical tone data is inputted at that position, the flow advances to step S90. However, if NO in step S88, since this means that musical tone data to be produced is inputted at that position, the CPU 1 calls a data storage routine (FIG. 15) to store input data as edit data EDTD, and the flow advances to step S90.

In step S90, the current edit position I and the duration D are respectively incremented by 1, and it is checked in step S91 if the current edit position I has reached the total duration ttm of the melody. If NO in step S91, the flow returns to step S85 to perform edit processing associated with the next position I.

If YES in step S91, since this means that the edit processing of the corresponding part is completed, the content of the counter D is set in edit data EDTD(PRT, J) to store a duration of the last input key code in step S92. Also, an end code is set in edit data EDTD(PRT,J+1). In step S93, the part PRT is incremented by 1, and it is checked in step S94 if the part PRT exceeds "4". If NO in step S94, the flow returns to step S82 to edit the next part. However, if YES in step S94, the flow returns to the main routine.

The presentation data detection routine in step S87 in FIG. 12 will be described below with reference to the flow chart of FIG. 13. In step S101 in the presentation data detection routine, minimum j, k, and r, which satisfy the following relations, are detected, and are set in working registers j, k, and r:

I<ML(0)+ML(1)+. . . +ML(j) and

I<CL(0)+CL(1)+. . . +CL(k) and

I<TL(0)+TL(1)+. . . +TL(r)

Thus, data indicating a tone in the melody data, which tone includes the current edit position I, is set in the working register j, data indicating a tone in chord data, which tone includes the current edit position I, is set in the working register k, and data indicating a tonality in a music, which tonality includes the current edit position I, is set in the working register r.

Figure 14:
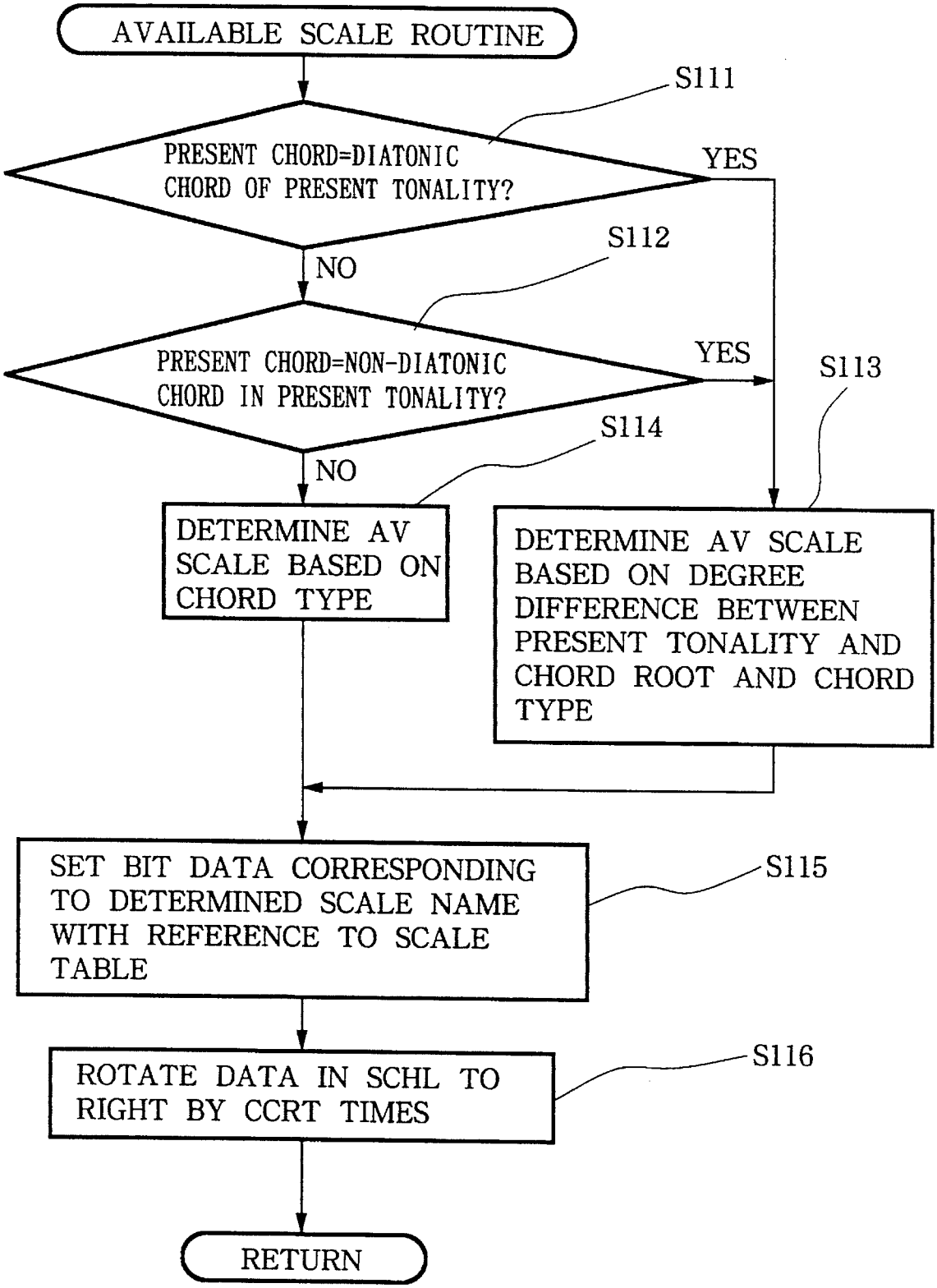
FIG. 14 is a flow chart of an available scale routine.

In step S102, a key code MP(j) of the melody is set in a working register CMP, a root CRT(k) of the chord is set in a working register CCRT, a type CTP(k) of the chord is set in a working register CCTP, a tonic TN(r) of the tonality is set in a working register CTN, and a mode MD(r) of the tonality is set in a working register CMD. In step S103, the CPU 1 calls an AV scale routine (FIG. 14). In the AV scale routine, bit data according to an available scale is set.

In step S104, "0" is set in bits of the candidate tone register SCHL, which bits correspond to pitch names in a minor ninth relation to a melody tone at the current position or tones in other parts. In step S105, the LEDs 13 of the pitch names corresponding to bits "1" in the candidate tone register SCHL flash, and the LEDs 13 of other pitch names are turned off. Then, the flow returns to the arrangement routine.

In this embodiment, candidate tones are indicated by flashing the LEDs 13. However, another method may be used. For example, in place of step S105, like in step S106, tones having tone pitches having the pitch names, of a proper octave, corresponding to bits "1" in the candidate tone register SCHL may be produced one by one in the order from a lower pitch. In addition, these methods may be combined.

The AV scale routine in step S103 in FIG. 13 will be described below with reference to the flow chart shown in FIG. 14. In the AV scale routine, in step S111, it is checked if the current chord is a diatonic chord of the current tonality. If YES in step S111, the flow advances to step S113.

However, if NO in step S111, it is checked in step S112 if the current chord is a non-diatonic chord in the current tonality. If YES in step S112, the flow advances to step S113; otherwise, the flow advances to step S114.

In step S113, a scale name serving as the AV scale is determined using the AV scale table shown in FIG. 4 on the basis of the degree difference (interval difference) between the tonic of the current tonality and the chord root, and the current chord type. The flow then advances to step S115. In step S104, a scale name serving as the AV scale is determined using the AV scale table shown in FIG. 5 on the basis of the current chord type. Then, the flow advances to step S115.

In step S115, bit data is read out from the scale table shown in FIG. 6 on the basis of the determined scale name, and is set in the candidate tone register SCHL. When the flow advances from step S114 to step S115, a plurality of scale names are often determined. At this time, bit data corresponding to these scale names are read out, are logically ORed, and the ORed result is set in the candidate tone register SCHL. In step S116, the content of the candidate tone register is rotated in the right direction according to the root CCRT of the current chord, and the flow then returns to the presentation data detection routine.

Figure 15:
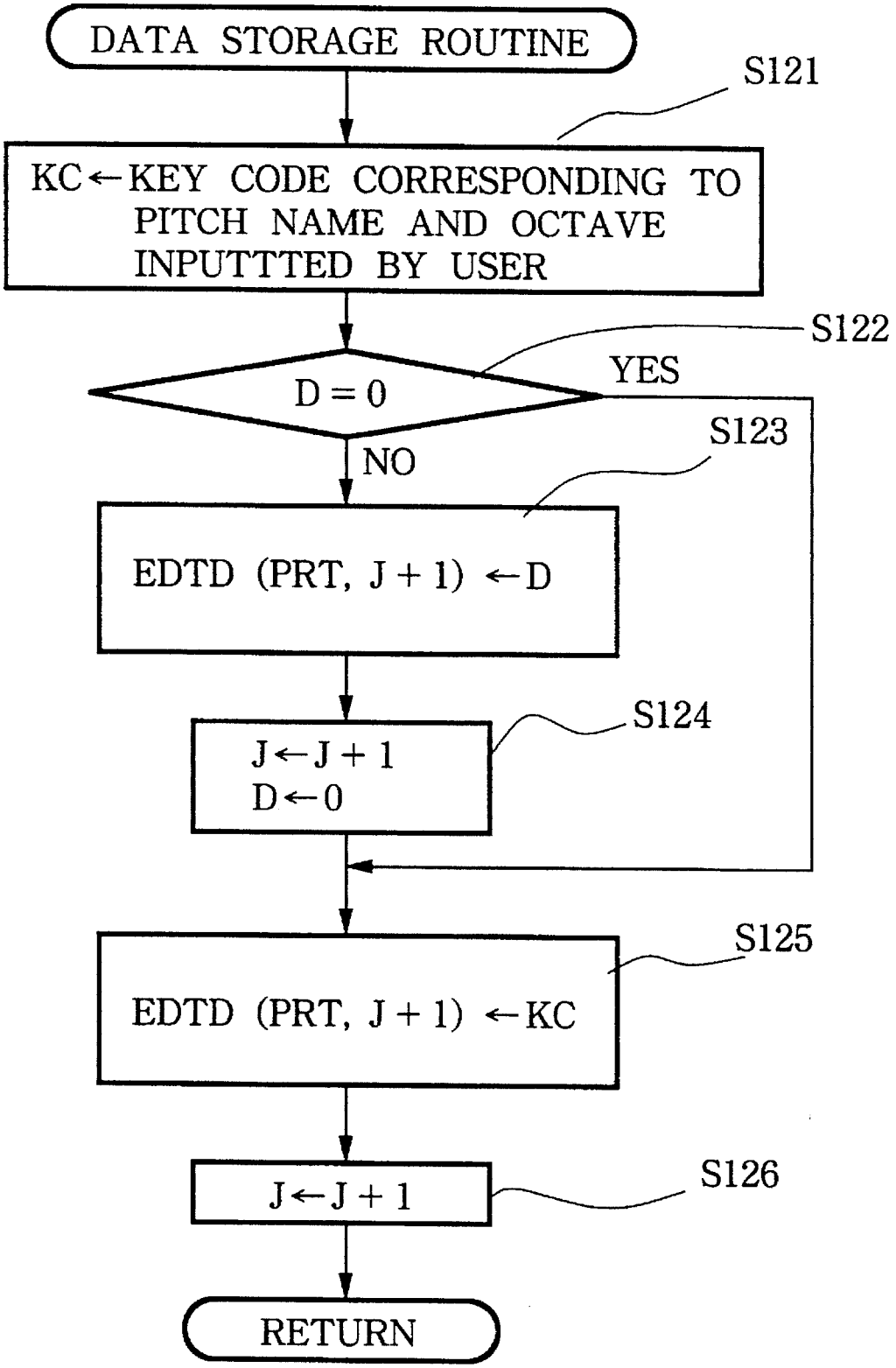
FIG. 15 is a flow chart of a data storage routine.

The data storage routine in step S89 in FIG. 12 will be described below with reference to the flow chart of FIG. 15. In the data storage routine, in step S121, a key code corresponding to a pitch name and an octave inputted by a user is set in a working register KC, and the key code is displayed on the display 7. FIG. 16E shows an display example on the display 7 in step S121. This display example indicates that the current edit part is the first part, and a key code "E1" is inputted at the position of a quantize "1" of the first beat in the first bar.

In step S122, it is checked if the duration counter D is "0". If YES in step S122, since a key code must be stored in edit data EDTD, the key code KC inputted by the user is stored in edit data EDTD(PRT,J) in step S125. In step S126, the content of a working register J is incremented by 1, and the flow returns to the arrangement routine.

If it is determined in step S122 that the duration counter D is not "0", since a duration of a tone inputted before the tone which is currently inputted by the user must be stored in edit data EDTD, the value of the counter D is stored in edit data EDTD(PRT,J) in step S123. Note that the counter D is incremented in step S90. The flow then advances to step S124. In step S124, the working register J is incremented by "1", and the counter D is initialized to "0". Thereafter, the flow advances to step S125. In step S125, storage processing of the key code of the above-mentioned current input tone is executed.

In the above embodiment, the LEDs 13 are used to indicate candidate tones. However, the present invention is not limited to this, and various other informing methods may be adopted. For example, a staff notation pattern may be displayed. The rules for determining candidate tones are not limited to those in the above embodiment, and various other rules may be used. For example, tones in a minor ninth relation to melody tones are excluded, but they may not be excluded. Alternatively, avoid notes may be excluded, or tones whose tone pitches move parallel to melody tones or tones in other parts may be excluded, or these conditions may be combined.

As described above, according to the present invention, since candidate tones harmonizing input performance information are informed a user of, he or she can detect tones musically harmonizing arbitrary parts including a melody part upon composition/arrangement of a multi-part music, and can perform the composition/arrangement in consideration of musical harmony. Therefore, even when a person having little musical knowledge composes/arranges a music, he or she can easily do it in consideration of musical harmony.

What is claimed is:

1. A musical composition/arrangement assisting apparatus comprising:

performance information input means for inputting performance information corresponding to at least one part of a music to be performed which comprises plural parts;

candidate note determining means for determining candidate notes for another part of said music, said candidate notes being determined by said performance information;

informing means for informing an operator of said candidate notes; and selecting means for allowing said operator to select at least one of said candidate notes for inclusion in said other part of said music.

2. An apparatus according to claim 1, wherein said candidate note determining means comprises scale determining means for determining a scale corresponding to said performance information, said candidate note being a note on said scale.

3. An apparatus according to claim 1, wherein said candidate note determining means comprises avoid note determining means for determining an avoid note determined based on said performance information, said candidate note not including said avoid note.

4. An apparatus according to claim 1, wherein said performance information includes melody information.

5. An apparatus according to claim 1, wherein said performance information includes melody information, and tonality information and chord information, which are obtained on the basis of said melody information.

6. An apparatus according to claim 1, wherein said performance information includes tonality information.

7. An apparatus according to claim 1, wherein said performance information includes chord information.

8. An apparatus according to claim 2, wherein said scale is determined on the basis of a current tonality and a current chord, and said candidate note is determined according to the determined scale.

9. An apparatus according to claim 8, wherein said scale is determined depending on whether the current chord is a diatonic chord of the current tonality, a non-diatonic chord in the current tonality, or a non-diatonic chord outside the current tonality.

10. An apparatus according to claim 3, wherein said avoid note is a note parallel to a note of said melody.

11. An apparatus according to claim 3, wherein said avoid note is a note in a minor ninth relation to a note of said melody.

12. An apparatus according to claim 1, further comprising:

means for storing said performance information; and means for outputting the stored performance information.

13. An apparatus according to claim 12, wherein said performance information is information based on MIDI standards.

14. An apparatus according to claim 1 further comprising selecting means for selecting a note of another part by the operator.

15. A music composition machine assisted method for composing music comprising:

inputting performance information into the music composition machine corresponding to at least one part of a music to be performed which comprises plural parts;

determining candidate notes for another part of said music by the music composition machine, said candidate notes being determined by said inputted performance information;

informing an operator of said candidate notes determined by the music composition machine; and allowing said operator to select at least one of said candidate notes for inclusion in said other part of said music.

* * * * *